US005407099A

United States Patent [19]

Heuke et al.

[11] Patent Number: 5,407,099

[45] Date of Patent: Apr. 18, 1995

[54] DEVICE FOR WITHDRAWING FILLING MATERIAL FROM BAGS

[75] Inventors: Karl-Heinrich Heucke, Norderstedt; Guenter Schmitz, Hamburg, both of Germany

[73] Assignees: Minnesota Mining and Manufacturing Company, St. Paul, Minn.;

[21] Appl. No.: 961,684

[22] PCT Filed: Jun. 3, 1991

[86] PCT No.: PCT/US91/03911

§ 371 Date: Mar. 9, 1994

§ 102(e) Date: Mar. 9, 1994

[87] PCT Pub. No.: WO92/00895

PCT Pub. Date: Jan. 23, 1992

[30] Foreign Application Priority Data

Jul. 7, 1990 [DE] Germany ..... 40 21 743.4

[51] Int. Cl.[6] ..... B67B 7/24

[52] U.S. Cl. ..... 222/83; 222/90

[58] Field of Search ..... 222/81, 83, 88, 89, 222/90, 107, 105

[56] References Cited

U.S. PATENT DOCUMENTS

| | | | |
|---|---|---|---|
| 3,792,799 | 2/1974 | Henfrey | 222/90 X |
| 3,938,707 | 2/1976 | Schmit | 222/88 X |
| 4,076,147 | 2/1978 | Schmit | 222/89 |
| 4,257,535 | 3/1981 | Mellett | 222/83 X |
| 4,603,793 | 8/1986 | Stern | 222/105 |
| 4,679,705 | 7/1987 | Hamilton | 222/90 |
| 4,776,488 | 10/1988 | Gurzan | 222/81 |
| 4,946,040 | 8/1990 | Ipenburg | 222/81 |
| 5,127,550 | 7/1992 | Knorr | 222/83 |

FOREIGN PATENT DOCUMENTS

| | | |
|---|---|---|
| 491840 | 3/1978 | Australia . |
| 0322980 | 7/1989 | European Pat. Off. . |
| 180894 | 1/1955 | Germany . |
| 7034843 | 9/1970 | Germany . |
| 2525000 | 12/1976 | Germany . |
| 3129777 | 9/1982 | Germany . |
| 3544244 | 6/1987 | Germany . |
| 1104359 | 2/1968 | United Kingdom . |
| 2203125 | 10/1988 | United Kingdom . |
| WO81/01992 | 7/1981 | WIPO . |
| WO92/00895 | 1/1992 | WIPO . |

*Primary Examiner*—Kevin P. Shaver

*Attorney, Agent, or Firm*—Gary L. Griswold; Walter N. Kirn; David W. Anderson

[57] ABSTRACT

A sealing member inside the bag and a withdrawing member outside the bag can be interplugged and cooperate by complimentary conical sealing surfaces to dispense flowable material from the bag. A retaining member is attached to the outer side of the bag wall and clamps a portion of the bag wall between the retaining member and the sealing member to allow a plastic deformation of that portion by the withdrawing member until it ruptures.

11 Claims, 3 Drawing Sheets

DEVICE FOR WITHDRAWING FILLING MATERIAL FROM BAGS

The invention relates to a device for withdrawing flowable filling material through a wall of a bag having flexible walls.

PRIOR ART

Frequently, a flowable filling material, particularly resin-like plastic, shall be withdrawn from a bag without coming into contact with the atmosphere or with the human skin. Also, only a partial amount shall often be withdrawn, and it is then desirable that a detachable closure can be conveniently provided at the bag. For this and other purposes, devices of the kind initially described have been developed.

From the German patent specification 25 25 000, a device for withdrawing flowable filling material has become known wherein separating means provided at the withdrawing part consist of a central conical tip which comprises a through-going opening in its sidewall. A flat conical surface is connected to its base which forms a sealing surface and co-operates with a matching sealing surface of a sealing part inside the bag. Upon the plugging-together, the bag wall must be severed before the sealing surfaces meet and a further relative movement in the plugging direction is no longer possible. In this reference, nothing is said about how the interplugged parts are held together.

From the German patent specification 31 29 777, a device for withdrawing flowable filling material through a flexible wall of a bag has become known wherein an annular coupling portion is adhered to the inner wall o the bag. A further coupling portion serving as the withdrawing part is tubular and includes annular ridges saw-teeth-like in cross section at the outer side thereof. The withdrawing part is adapted to penetrate the bag wall in the area of the opening of the annular inner coupling portion with the annular ridges snappingly engaging the edge of the opening of the annular coupling surface of an annular ridge facing oppositely to the plugging direction engages the associated surface of the annular coupling portion under pretension which is generated by the pierced bag wall. The known withdrawing device requires a fixation of the annular coupling portion in the interior of the bag which is relatively expensive in production.

The British patent specification 1 104 359 discloses a withdrawing device wherein an annular withdrawing part is sealingly attached to the inner wall of the bag, e.g. by welding. The sleeve-like withdrawing part includes an annular groove which is engaged by the edge of an opening of an annular sealing portion by a snapping operation when the withdrawing part pierces the bag wall and is plugged into the sealing portion. The withdrawing part and sealing part have annular cylindrical sealing surfaces which serve to restrict a leakage of the flowable medium between the withdrawing and sealing parts.

With the known devices, the bag wall first is fixed before it is pierced by suitable separating means. Such devices may work satisfactory if the pressure during the dispensing process is not too large. In case the pressure exceeds predetermined values, it may occur that the sealing cannot be maintained sufficiently or the filling material leaks out due to failures in the sealing and/or a rupture of the bag wall. This has to be absolutely avoided for obvious reasons.

SUMMARY OF THE INVENTION

The invention provides a device for withdrawing flowable filling material through the flexible wall of a bag which effectively restricts an insufficient sealing or a rupture of the bag wall in the area of the withdrawing device and thus an undesired leakage of the material.

The device of the present invention for withdrawing flowable filling material through a wall of a bag having flexible walls comprises a sealing member arranged inside said bag, which has an annular sealing surface and an axial through-going passage approximately circular in cross section and extending substantially perpendicular to said annular sealing surface, which passage defines an axial sealing surface, and a withdrawing member arranged outside the bag. The withdrawing member has a tubular portion provided with an outer annular axially extending sealing surface and the tubular portion is adapted to be plugged into the passage of the sealing member after the flexible bag wall has been pierced by the free end of the tubular portion. After the axial sealing surfaces of the tubular portion of the withdrawing member and the passage in the sealing member are brought into mutual engagement, a conical end portion on the tubular portion, having the outer side thereof tapering towards the free end, makes complimentary engagement with a conical portion of the sealing member. Further, a retaining member, adapted to be sealingly attached to the outer side of said flexible bag wall preferably by an adhesive, and having a throughbore, the diameter thereof being equal to or slightly larger than the outer diameter of said tubular portion, is adapted to be oriented on the outside of the bag such that the passage of the sealing member and said throughbore of the retaining member are approximately coaxial.

DESCRIPTION OF THE ACCOMPANYING DRAWING

Several presently preferred embodiments of the invention will be described subsequently in more detail in connection with drawing, wherein.

DETAILED DESCRIPTION OF THE PRESENTLY PREFERRED EMBODIMENTS

Figure 1:
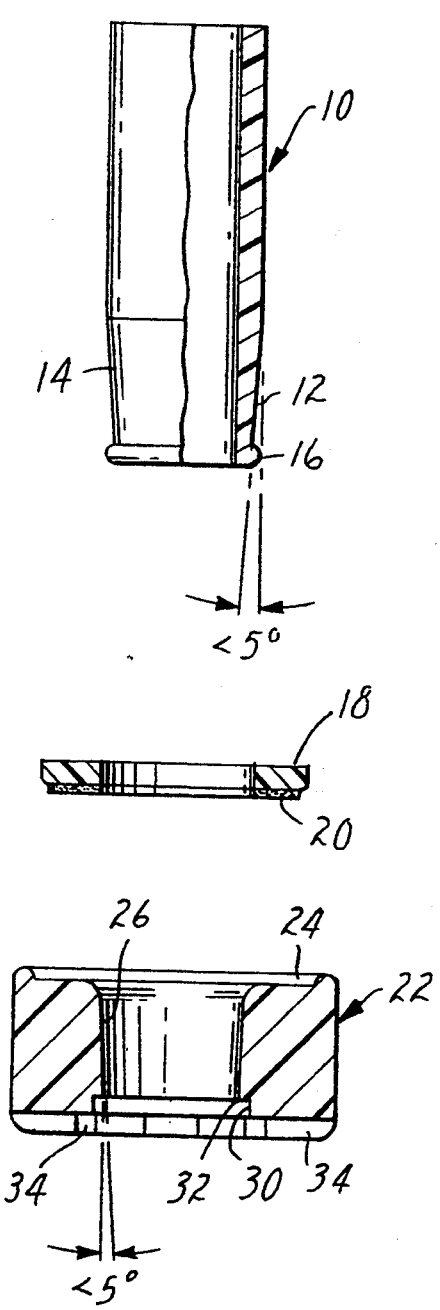
FIG. 1 is a cross-sectional sideview of parts of a device according to the invention.

The device according to the invention includes a tubular withdrawing portion with a conical end portion, the outer surface thereof tapering conically towards the free end. A sealing member having a passage with a conical portion formed complimentarily to the end portion. A further feature of the invention is represented by a retaining member sealingly attachable to the outer side of a flexible bag wall, preferably by an adhesive. It includes a throughbore, the diameter thereof being equal to or slightly larger than the outer diameter of the tubular portion.

The sealing member is loosely placed inside the bag when it is filled with the flowable material. If the contents of the bag is to be withdrawn, first the annular retaining member is sealingly attached to a desired location on the outer side of the bag, preferably by means of an adhesive. According to an embodiment of the invention, an adhesive layer can be provided on the annular retaining member, preferably a pressure-sensitive adhesive in order to achieve a simple attachment to the bag wall. Thereafter, the sealing member inside the bag is aligned with the retaining member until the bore of the retaining member and the passage of the sealing member are approximately coaxial. The orientation of the sealing member is such that the conical portion of the passage enlarges towards the retaining member. For this purpose, it is appropriate to provide the sealing member with respective colored or other marks to allow the operator to determine the accurate placement of the sealing member. Thereafter, the tubular portion of the withdrawing member is placed within the bore of the retaining member against the portion of the bag wall clamped between the retaining and sealing member. Upon progressive axial pressure on the tubular portion, first the clamped portion of the bag wall is resiliently and finally plastically deformed so that it is placed between the conical portions of the tubular portion and the sealing member with a reduced thickness. Finally, the deformation and the stretching of the portion reaches an extent that it ruptures. By this, a passage is formed between the interior of the bag and the tubular portion through which the contents of the bag can be dispensed via the tubular portion or the withdrawing member, respectively, in the known manner.

With the device according to the invention, thus, the wall of the bag is not pierced or cut, rather, similar to a deepdrawing process is first resiliently and thereafter plastically deformed to an extent that it ruptures. By this, a portion of the deformed wall having a smaller thickness is pressed between the cones of the tubular portion and the sealing member. The described structure of the device according to the invention and the sealing achieved thereby enables a dispensing of the contents of the bag also under high pressure without running the risk that the flowable material exits in an undesired manner. The maximum pressure which can be applied upon a dispensing operation is solely dependant on the burst strength of the bag.

According to an embodiment of the invention, the cone angle of the end portion and the passage is dimensioned such that a self-locking is effected. Preferably, the cone angle is smaller than 5°. The self-locking has the result that additional locking means to retain the tubular portion of the withdrawing member within the sealing member are not necessary. However, in some cases, the contents of the bag may provide lubricating properties. Small amounts of the material may enter the space between the stretched bag wall and the cone of the sealing member and prevent an effective friction. For this case, an embodiment of the invention provides that the passage of the sealing member includes a locking portion or recess of larger diameter at the end opposite to the retaining member, and the end portion of the withdrawing member has a radial annularly extending enlargement which snaps into the locking recess when the tubular portion is plugged into the passage. The tubular portion is of relatively hard plastic material while the sealing member is of softer plastic material which preferably has resilient properties. The outer diameter of the radial enlargement is slightly larger than the smallest diameter of the conical portion of the passage so that a small deformation of the sealing member occurs temporarily until the radial enlargement engages the locking recess. By this, a further effect is achieved to effectively separate the stretched bag wall. The annular edge between the conical portion of the passage and the locking recess can be shaped relatively sharp. Upon forcing the radial enlargement into the recess, the bag wall is bent at the relatively sharp edge and is sheared off.

The sealing member has to have a relatively large thickness to guarantee that the clamped bag wall ruptures before the cones of the tubular portion and the sealing member interengage. It is understood that the thickness depends upon the material of the bag and the thickness of its wall.

In order to achieve the described coaxial alignment of the retaining and sealing member, these parts may have cooperating guiding means through which the coaxial position of the parts is accomplished. In an embodiment of the invention, a recess is formed in the surface of the sealing member facing the retaining member, the recess accommodating a guiding portion of the retaining member and securing the sealing member against lateral displacement. The plugging-in of the withdrawing member into the sealing member is facilitated if the bag is placed on a firm base so that also the opposite side of the sealing member engages the bag wall. In order to allow a partial escape of the flowable material out of the passage of the sealing member during the plugging-in of the withdrawing member, the other end of the sealing member oppositely located to the retaining member may be provided with at least one radial groove or a radial passage to establish a connection of the passage with the interior of the bag.

Referring now to the drawing in FIG. 1, the sleeve-like or tubular withdrawing member 10 is shown partially in cross section. The lower portion 12 thereof has an outer cone 14 which tapers towards the free end. An annular radial enlargement 16 is formed at the free end. The other end of the withdrawing member 10 can be arbitrarily shaped to adapt it to a desired use. For example, it may be provided with a thread or with another configuration in order to be connected with a container to be filled.

The cone angle of the end portion 12 is less than 5°.

In FIG. 1, also the annular retaining member 18 is shown in cross section consisting of plastic material and having a relatively small thickness. The lower side thereof is provided with a layer 20 of pressure-sensitive adhesive which is covered by a removable protection layer. The inner diameter of the annular member 18 is equal to or slightly larger than the outer diameter of the tubular withdrawing member 10.

Finally, in FIG. 1 the annular sealing member is shown in cross section which has a thickness much larger than that of the retaining member 18. The outer configuration of the sealing member 22 is cylindrical.

The sealing member 22 includes an annular sealing surface including a recess 24 at the front end facing the retaining member 18, with the diameter of the recess being slightly larger than the outer diameter of the retaining member 18. The annular sealing member 22 includes a passage therethrough, defining an axial sealing surface, having a conical portion 26 formed complementary to the conical portion 14 of withdrawing member 10. An annular recess 30 joins to the conical portion 26 and has a larger diameter. The smallest diameter of the conical portion 26 at the edge 32 is slightly smaller than the outer diameter of the radial enlargement 16. The edge 32 joining the conical portion 26 of the passage and recess 30 is shaped relatively sharp. The sealing member 22 includes a plurality of radial passages 34 at the front end opposite to recess 24 which interconnect the passage and the interior of a bag.

In FIGS. 2 to 6, a bag 40 is shown filled with a flowable filling material 42, e.g. resin-like plastic material. The bag 40 is made of two sheets 44, 46 of plastic material forming the flexible walls of the bag 40 and being welded at margin 48. Inside the bag, the annular sealing member is loosely inserted. Selectively, the sealing member 22 may be attached to the inner side of the bag wall, e.g. by an adhesive or welding.

Figure 3:
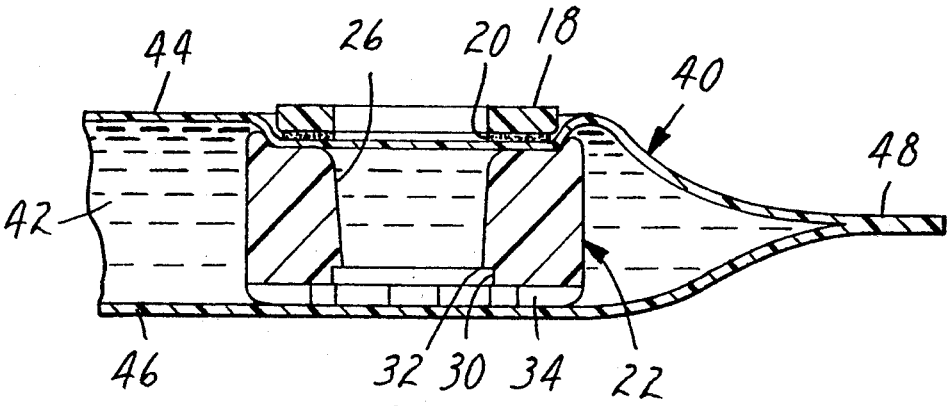
FIG. 3 is a fragmentary cross-sectional view similar to FIG. 2 additionally including the annular retaining member of FIG. 1 attached to the outer side of the bag wall.

In order to obtain access to bag 40 and to withdraw the filling material 42, the annular sealing member 22 is placed at a desired location. The operator may simply determine the orientation of sealing member 22 through a corresponding configuration thereof. The retaining member 18 is adhered to the outer side of bag wall 44 as shown in FIG. 3. It is understood that annular member 18 may be continuously attached to bag 40 prior to or shortly after the filling of bag 14, e.g. through an adhesive, ultrasonic welding or the like. If the retaining member 18 is not permanently attached to bag 40, it forms a kit with the withdrawing member 10 and can be delivered with bag 40.

The alignment of retaining member 18 and sealing member 22 is facilitated by recess 24 which partially accommodates retaining member 18 and secures sealing member 22 against lateral displacement. It is emphasized that a sufficient sealing has to take place between retaining member 18 and bag wall 44.

Figure 6:
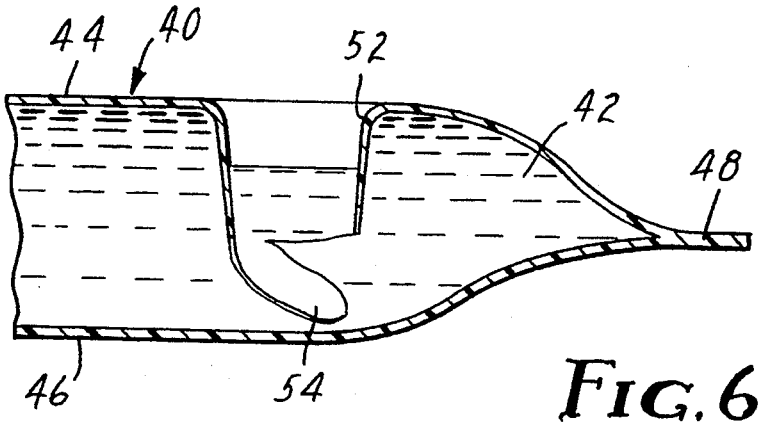
FIG. 6 is a view of the bag shown in FIGS. 2 to 5 without a withdrawing device after being deformed by the withdrawing device in the mode shown in FIG. 5.
Figure 2:
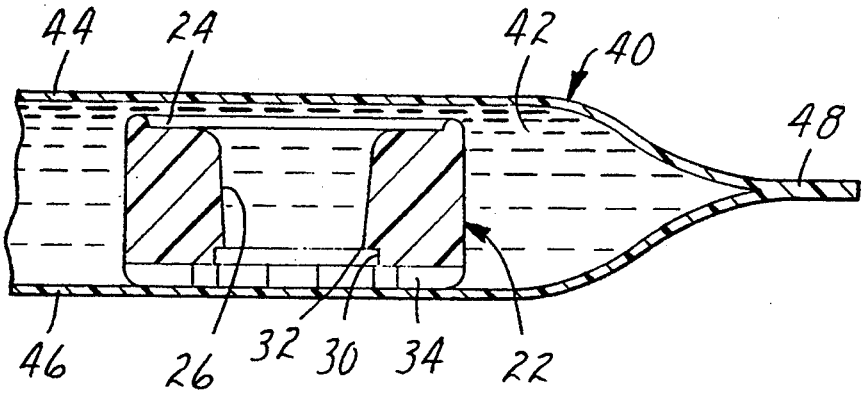
FIG. 2 is a cross-sectional view of the sealing member of the device of FIG. 1 inside a bag filled with filling material.
Figure 4:
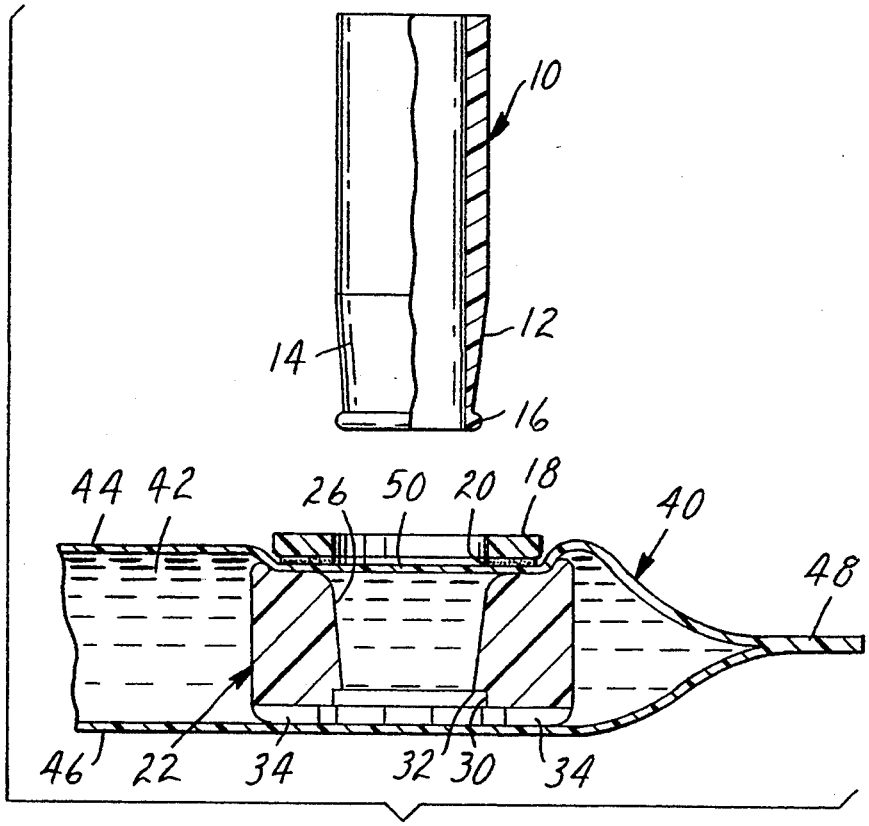
FIG. 4 is a cross-sectional view similar to FIG. 3 additionally including the withdrawing member of FIG. 1 shortly prior to its plugging-in into the sealing member.
Figure 5:
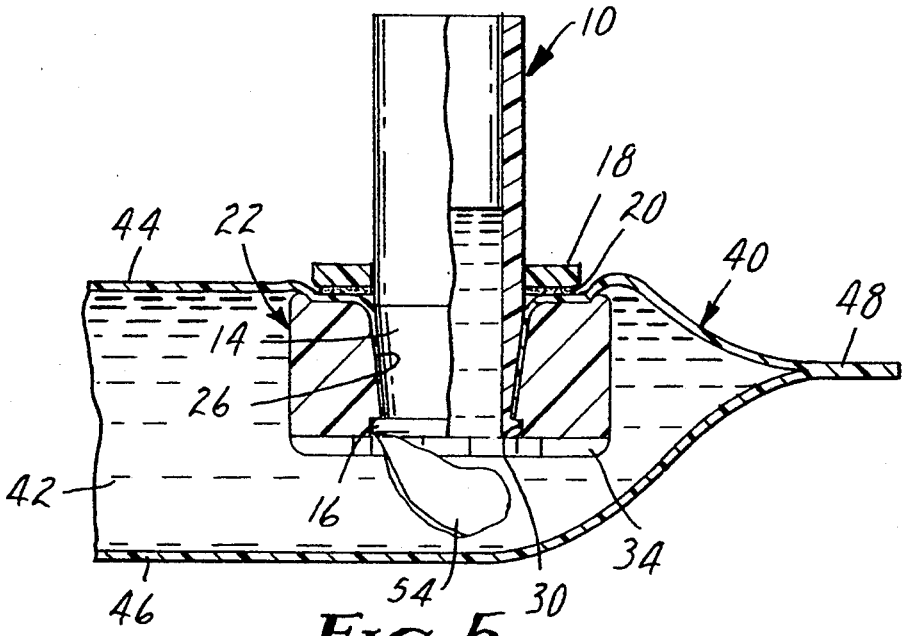
FIG. 5 is a view of the device according to the invention showing a mode wherein the withdrawing member is completely plugged into the sealing member.

As shown in FIGS. 4 and 5, withdrawing member 10 has to be positioned relative to retaining member 18 for the withdrawing operation. Thereafter, withdrawing member 10 is placed into the bore of retaining member 18 against portion 50 of bag wall 44 clamped between retaining member 18 and sealing member 22. In the embodiment of FIG. 4, bag 40 is placed on a base, not shown, so that the bag wall 46 engages the lower side of sealing member 22. If the conical end portion 22 of withdrawing member 10 is urged against portion 50, this first is resiliently deformed and thereafter, stretched and finally plastically deformed so that it results in a conically deformed portion 52 as shown in FIG. 6. The deformation is such that finally, the lower part of portion 52 ruptures as shown at 54 before the conical portions 12, 14 and 26 interengage. The radial annular enlargement 16 having a slightly smaller diameter than the diameter of the relatively sharp edge 32 forces the stretched bag wall against the sharp edge 32 and effects a rupture of the bag wall at the latest when the enlargement 16 engages the annular recess 30. This results in a locking operation effecting the withdrawing member 10 to stay in the position shown even though a small friction may occur between the conical portions 12, 14 and 26, respectively, and of the filling material 42 being dispensed under high pressure.

A series of radial passages 34 enable an escape of a portion of the filling material out of the passage of the sealing member upon the withdrawing member 10 being plugged into sealing member 22 when the bag is placed on a base as shown in FIG. 4 and the bag wall 46 causes a sealing of the lower end surface of sealing member 22.

We claim:

1. A device for withdrawing flowable filling material through a wall of a bag having flexible walls, comprising a sealing member arranged inside said bag and having an annular sealing surface and an axial throughgoing passage approximately circular in cross section and extending substantially perpendicular to said annular sealing surface, said passage defining an axial sealing surface, and a withdrawing member arranged outside said bag and having a tubular portion provided with an outer annular axially extending sealing surface, said tubular portion including a conical end portion and provided with an outer annular axially extending sealing surface, said tubular portion being adapted to be plugged into said passage of said sealing member after said flexible wall has been pierced by a free end of said tubular portion, with said axial sealing surfaces of said tubular portion of said withdrawing member and said passage being brought into mutual engagement, characterized in that said passage of said sealing member has a conical portion substantially complementary to said conical end portion, with the length of said conical portion of said withdrawing member and said conical portion of said sealing member selected such that the material of the bag wall rupture when said concial portions interengage, and that a retaining member is adapted to be sealingly attached to the outer side of said flexible bag wall, said retaining member having a throughbore, the diameter thereof being equal to or slightly larger than the outer diameter of said tubular portion, of said withdrawing member, with said sealing member being adapted to be oriented such that said passage of said sealing member and said throughbore of said retaining member are approximately coaxial.

2. The device of claim 1, wherein the cone angle of said end portion and of said conical portion of said passage is dimensioned such that a self-locking is achieved.

3. The device is claim 1 or 2, wherein said retaining member is defined by a ring of relatively small thickness.

4. The device of claim 1, wherein said sealing member is defined by a ring of relatively large thickness.

5. The device of claim 1, wherein said retaining member and said sealing member have co-operating guiding means for fixing the coaxial position of said members.

6. The device of claim 5, wherein said guiding means comprises an end surface of said sealing member facing said retaining member, which end surface has a recess and a guiding portion of said retaining member, wherein said recess is adapted to accommodate said guiding portion to prevent a lateral displacement of said sealing member.

7. The device of claim 1, wherein said passage of said sealing member on the end opposite to said retaining member has a locking recess of larger diameter than said passage and said end portion of said withdrawing member has a radial, annularly extending enlargement which engages said locking recess when said tubular portion is plugged into said passage.

8. The device of claim 7, wherein an annular edge between said conical portion of said passage and of said locking recess is formed relatively sharp.

9. The device of claim 1, wherein said sealing member has at least one radial groove or passage at the end surface opposite to said retaining member to establish a connection of said passage of sealing member with the outer periphery of said sealing member.

10. The device of claim 1, wherein said tubular portion is made of relatively hard plastic material and said sealing member is formed of softer resilient plastic material.

11. The device of claim 1, wherein one side of said retaining member is provided with a layer of an adhesive, which comprises a pressure-sensitive adhesive which is covered by a removable protection layer.

* * * * *